US005694866A

United States Patent [19]

Muller

[11] Patent Number: 5,694,866

[45] Date of Patent: Dec. 9, 1997

[54] OUTDOOR FURNITURE COVERS AND COVERING METHODS

[76] Inventor: John J. Muller, 720 Mountain Rd., West Hartford, Conn. 06117

[21] Appl. No.: 762,205

[22] Filed: Dec. 9, 1996

Related U.S. Application Data

[62] Division of Ser. No. 309,929, Sep. 21, 1994, Pat. No. 5,582,115.

[51] Int. Cl.[6] ..... A47B 13/08

[52] U.S. Cl. ..... 108/161; 108/90; 297/228.12; 150/158; 156/256

[58] Field of Search ..... 108/90, 93, 161; 156/66, 108; 150/154, 158, 156, 166, 167; 297/228, 228.1, 228.12, 228.13, 184.14; 428/99, 100; 256/250, 256, 258, 267

[56] References Cited

U.S. PATENT DOCUMENTS

| | | | |
|---|---|---|---|
| 1,326,746 | 12/1919 | Junath | 150/158 |
| 2,228,948 | 1/1941 | Field | 297/228.12 |
| 3,066,435 | 12/1962 | Oddo et al. | 150/158 |
| 3,109,474 | 11/1963 | Levi | 150/158 |
| 4,627,363 | 12/1986 | Jones | 108/90 |
| 5,007,676 | 4/1991 | Lien | 297/228.13 |
| 5,582,115 | 12/1996 | Muller | 108/90 |

*Primary Examiner*—Peter M. Cuomo
*Assistant Examiner*—Gerald A. Anderson
*Attorney, Agent, or Firm*—McCormick, Paulding & Huber

[57] ABSTRACT

A cover for an umbrella table assembly receives an umbrella pole therethrough. A portion of the cover associated with the pole is releasably secured to the pole and maintained in elevated position by the pole to provide a tent-like structure which includes an annular peripheral skirt which depends below the table top. Releasable fasteners which secure a cover to an article are attached to the cover after the cover has been positioned on the article.

1 Claim, 5 Drawing Sheets

OUTDOOR FURNITURE COVERS AND COVERING METHODS

This is a division of application Ser. No. 309,929 filed on Sep. 21 1994, now U.S. Pat. No. 5,582,115.

BACKGROUND OF THE INVENTION

This invention relates in general to furniture covers and deals more particularly with improvements in covers and methods for covering casual or outdoor furniture.

The present invention is particularly concerned with improvements in covers and covering methods for porch and patio furniture, as, for example, umbrella tables, chairs and chaise lounges. Such outdoor furniture is produced by a large number of manufacturers in a wide variety of designs. Ready-made covers for such furniture generally lack the adaptability required to enable satisfactory performance with a wide range of furniture designs.

Such covers as have heretofore been available are usually made from relatively thick, bulky and/or inflexible materials which tend to become brittle and crack when subjected to freezing temperatures and are not readily foldable for storage. Consequently, provision for cover storage in situ is not usually feasible.

The fastening methods and means for securing such covers to associated articles of furniture are often inconvenient or totally ineffective. Some covers are provided with eyelets, fasteners or tie strings located at predetermined fixed positions to facilitate attachment to an associated article to be covered. However, in many instances the fasteners on such ready-made covers cannot be properly aligned with the available fastening locations on an article of furniture to be covered and, consequently, cannot be used to maintain proper tension of the cover. Other covers have been provided which include an end opening having a hem therearound containing a drawstring or an elastic closure member. However the weight of the cover itself combined with a rain or snow load is usually sufficient to cause the cover to sag, develop puddles, collect airborne debris and, as a result, become permanently soiled. Further, the weight and mobility of the puddled water makes it difficult to remove the cover without spilling water on the covered article or the person removing the cover. Experience has shown covers which rely entirely upon elastic retention lack sufficient wind resistance and often become dislodged, even under moderate wind conditions.

When a liquid impervious material is used to make a furniture cover the material may act as a vapor barrier entrapping moisture within the cover resulting in mildew on surfaces of the cover and the covered article as well.

The present invention is concerned with the aforedescribed general problems. Accordingly, it is the general aim of the present invention to provide an improved durable lightweight furniture cover for low cost production and which avoids the aforediscussed problems and which can be conveniently folded into a small package for storage in situ. It is a further aim of the present invention to provide an improved method for attaching a ready-made cover to an article of furniture whereby the cover is maintained in a taunt condition to shed water, debris and the like.

SUMMARY OF THE INVENTION

In accordance with the present invention, a cover assembly and covering method is provided for an umbrella table assembly which includes a table having an umbrella supported by an umbrella pole which projects upwardly from the table top and which may also include a plurality of chairs. The cover assembly includes a cover made from flaccid sheet material having an area of coverage substantially greater than the area of the table surface. A releasable fastener assembly attached to the cover and to the umbrella pole which extends through an aperture in the cover releasably retains a portion of the cover in upwardly spaced relation to the table surface to form a tent-like structure above the table having an apex at the umbrella pole. A depending skirt on the cover extends downwardly beyond the table top and covers the chairs when the chairs are part of the table assembly. A cover is attached to the article of furniture having one end at a higher elevation than its opposite end by releasable fasteners secured to the article and to the cover after the cover has been positioned on the article whereby proper tension may be maintained in the critical parts of the cover so that the cover will readily shed water and debris.

DETAILED DESCRIPTION OF PREFERRED EMBODIMENTS AND METHODS

Figure 1:
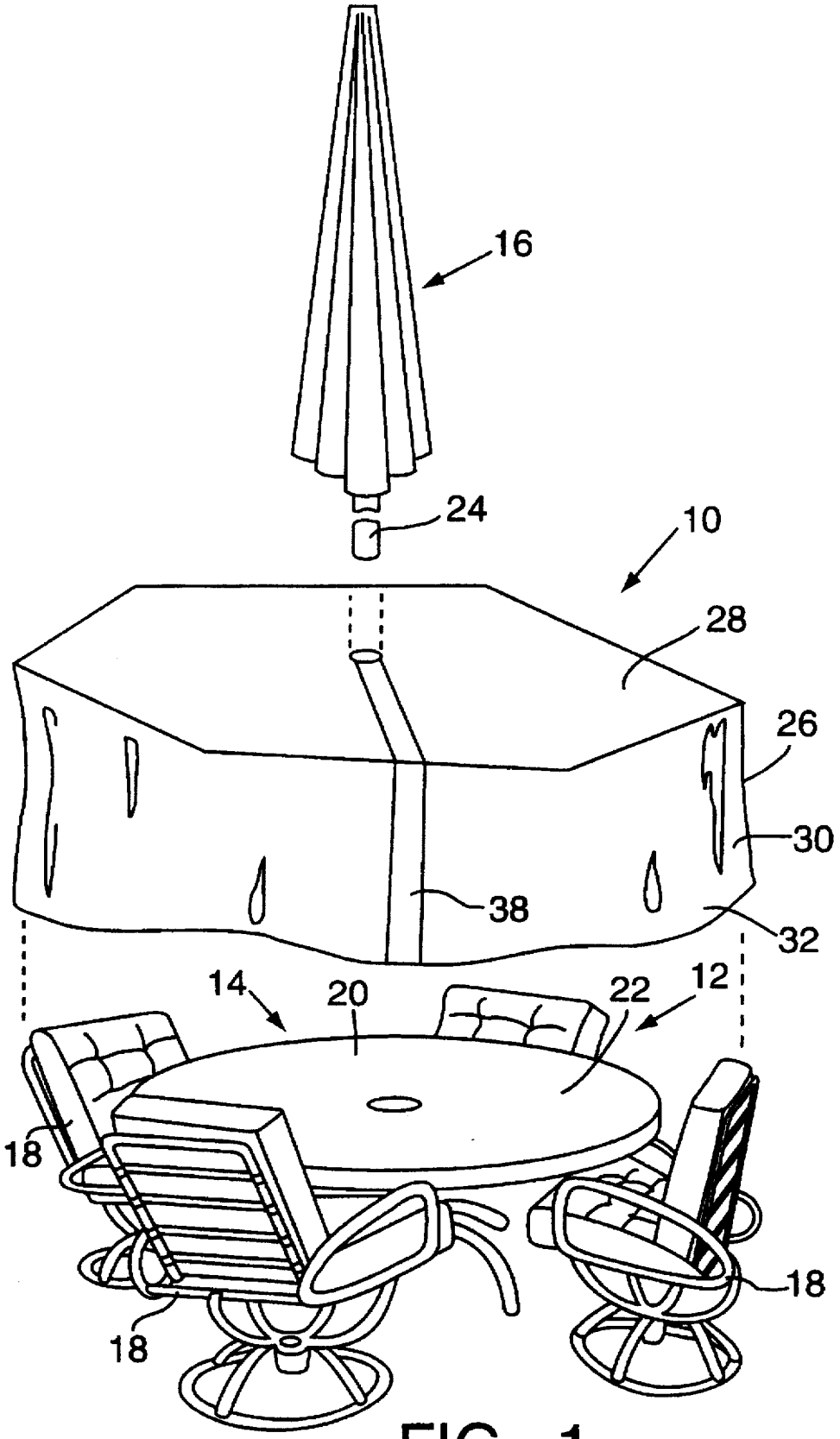
FIG. 1 is an exploded perspective view of a table assembly and a cover assembly embodying the invention for covering the table assembly.

Turning now to the drawings and referring first particularly to FIG. 1, a cover assembly embodying the present invention and used in practicing a method of the invention is indicated generally by the reference numeral 10. The cover assembly 10 particularly adapted to cover an umbrella table assembly indicated generally at 12 and which includes at least a table, indicated generally at 14 and a collapsible umbrella supported by the table and designated generally by the numeral 16. However, the illustrated cover assembly 10 may also cover a plurality of chairs 18, 18 arranged in normal seating position about the table, when the chairs comprise a part of the table assembly, as well be hereinafter further discussed.

The illustrated table 14 has a generally circular table top 20 and a table surface 22. The umbrella 16 is supported on the table in a conventional manner by an umbrella pole 24 which projects upwardly from the table top 20.

Further considering the cover assembly, the illustrated assembly 10 as shown in FIG. 1 includes a cover 26 which has a top panel 28. An annular peripheral skirt 30 sewn or otherwise suitably connected to the outer peripheral edge of the top panel 28 depends from it and terminates at an outer marginal portion 32 defined by a hem containing a drawstring 33.

The cover 26 defines an area of coverage substantially greater than the area of the table surface 22 and is made from a light-weight flaccid water-resistant sheet material. The presently preferred material is an olefin, marketed by DuPont under the trademark TYVEK. This non-woven fabric is extremely light-weight, resists tearing, punching, and abrasion and has a surface containing many tiny pores which prevent the passage of extremely small particles such as dust and pollen while allowing moisture vapor to escape through the material.

Figure 3:
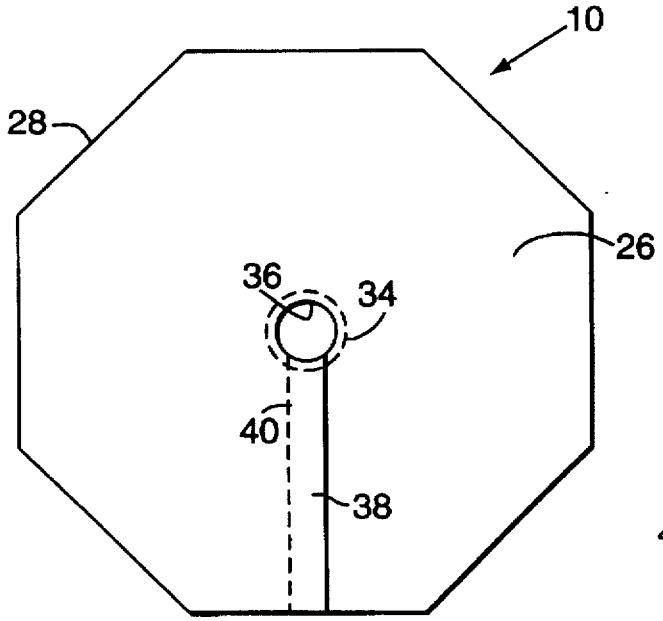
FIG. 3 is a plan view of the cover assembly.
Figure 4:
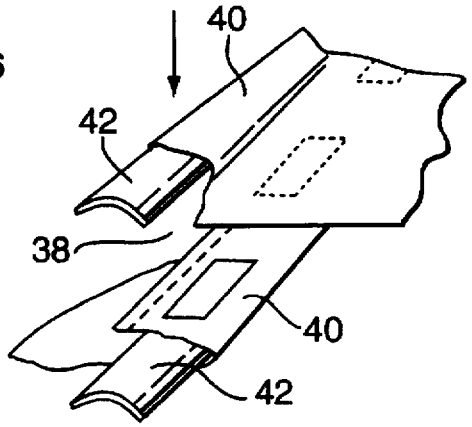
FIG. 4 is a somewhat enlarged fragmentary sectional view of a portion of the cover including the recloseable slit.

The size and shape of sheet material cover 26 may vary and will generally be determined by the shape of the table assembly to be covered. The illustrated cover 26 is particularly adapted to cover both the table assembly 12 which includes both the circular table 14 and a plurality of associated chairs 18, 18 and, for this reason, the top panel 28 has a generally octagonal configuration as best shown in FIG. 3.

Figure 6:
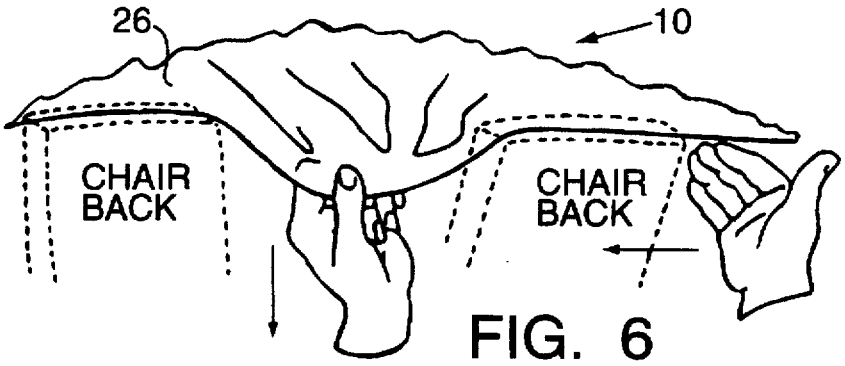
FIG. 6 illustrates the step of forming a drainage valley in the cover.

The top panel 28 has an inner marginal portion 34 which defines an aperture 36 sized to receive the umbrella pole 24 therethrough. Preferably, and as shown, a rectangular slit 38 extends from the aperture 36 through the top panel and through the annular skirt 30 to and through the outer marginal portion 32 separating contiguous portions of the cover 26 from each other. More specifically, the slit 38 is formed by overlapping hems 40, 40 on the adjacent contiguous portions of the cover. Each hem 40 contains an elongate batten 42 made from flexible metal or like-material and having an arcuate cross-section. The battens 42, 42 are readily flexible about transverse axes but resist flexure in the longitudinal direction and are arranged in the hems with the cross-sections thereof in complementary relation to each other as best shown in FIG. 6. Opposing patches of mating hook and loop fastener material is attached to the Overlapping hems 40, 40 for releasably securing the slit 38 in closed position.

Figure 5:
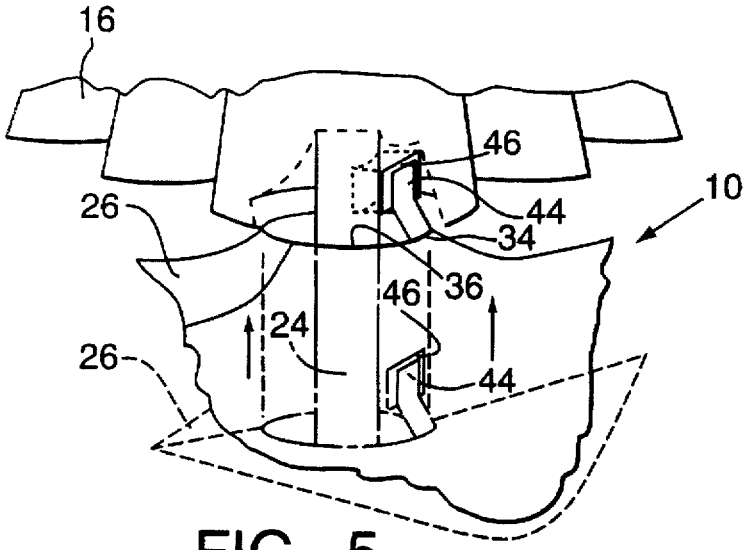
FIG. 5 is a somewhat enlarged fragmentary sectional view of a portion of the cover including the pole receiving aperture.

A flexible strap 44 shown in FIG. 5 and which comprises a part of the cover assembly is sewn or otherwise secured in fixed position to the cover 26 proximate the inner marginal portion 34, for a purpose which will be hereinafter further evident. The presently preferred strap fastener 44 comprises a part of a releasable hook and loop fastener and is preferably made from loop material. A patch of hook material 46, which comprises a part of a mating hook and loop fastener is releasably attached to the free end of the strap 44 and covered by a suitable release material.

Preparatory to covering the illustrated table assembly 12, which includes the table 14 and the chairs 18, 18 the chairs are arranged in normal seating position about the table 14 and in opposing relationship to each other at opposite sides of the table. The chairs are then moved inwardly toward the table to positions as dose as possible to the table.

The umbrella 16 is folded to a closed position and removed from assembly with the table. The cover 26 is then spread on the table surface 22 with the aperture 36 in registry with the pole receiving opening in the table top 20. The umbrella pole 24 is then reassembled with the table with the pole extending through the aperture 36.

If the cover is provided with a recloseable slit as previously described it is unnecessary to remove the umbrella from the table to spread the cover 26. The slit is opened to allow passage of the cover relative to the umbrella pole 24. The battens 40, 40 simplify opening and reclosing the slit 32 and positioning the cover 26 relative to the umbrella cover. After the cover has been positioned within the pole receiving aperture defined by the inner marginal portion 28 the slit is secured in closed position by the releasable fastener associated with it.

Figure 2:
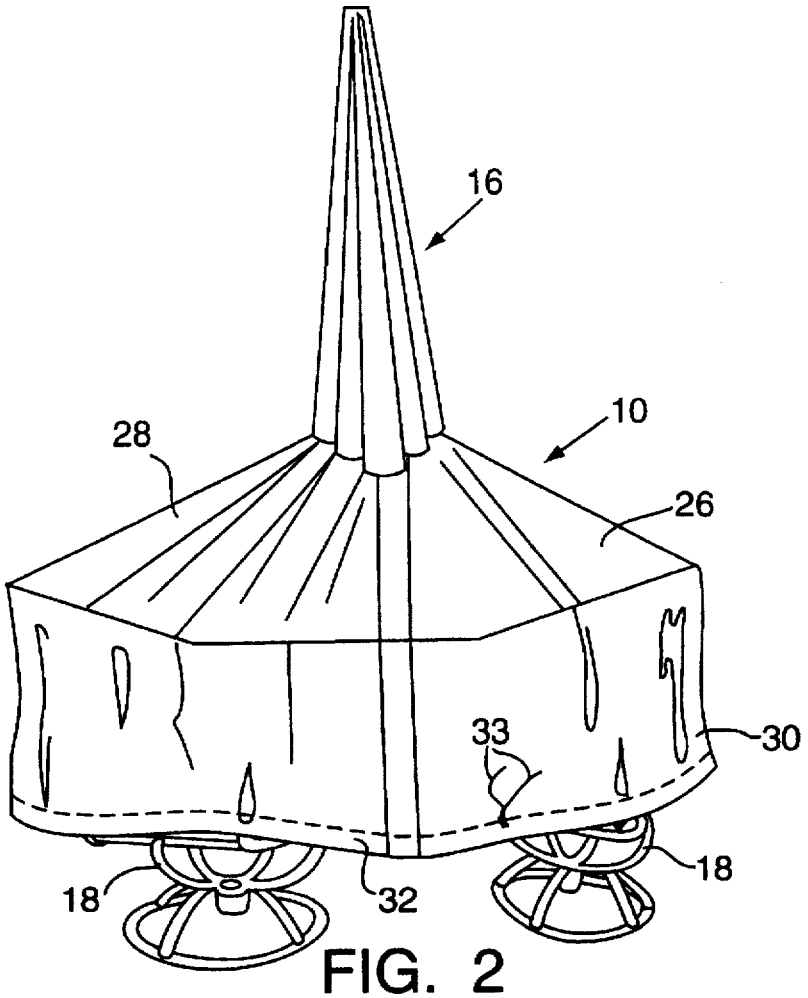
FIG. 2 is a perspective view showing the cover assembly in covering position on the table assembly.

The portion of the cover which defines the pole receiving aperture 36 is elevated to a position along the umbrella pole 24 and spaced upwardly from the table surface 22 as shown in FIG. 2. The cover is preferably elevated to a position along the pole and as high above the table surface 22 as is possible. If the umbrella has a crank mechanism for opening and dosing the umbrella the crank handle may limit the extent to which the cover may be elevated. However, such arrangements generally enable sufficient cover elevation.

The elevated portion of the cover is releasably secured to the umbrella pole by the flexible strap 44. More specifically, the release material is removed from hook material 46 releasably secured to the free end of the strap 44 to expose the pressure sensitive adhesive patch thereon which is used to adhere the hook material 46 to the umbrella pole 24 and to releasably retain the cover in its elevated position. The outer or skirt portion of the cover is draped over the table assembly 12. When the cover is in its generally covering position the top panel cooperates with the umbrella pole 24 to form a tent-like structure having an apex at the umbrella pole 24 and radiating outwardly and downwardly from the apex toward the peripheral edge of the table 14. As previously noted, the area of coverage provided by the cover 26 is substantially greater than the area of the table surface 22 and is of sufficient size to cover both the table and the chairs and extend downwardly beyond the table top to terminate above the surface on which the tables and chairs are supported. The outer marginal portion of the cover is secured to the table assembly below the table top. More specifically, the outer marginal portion is secured against the portion of the assembly defined by the chairs 18, 18 using the drawstring 33 to draw the outer marginal portion 32 inwardly toward and into engagement with associated portions of the chairs as it appears in FIG. 2, after which the drawstring is secured.

After the cover has been positioned in covering relation to the assembly and secured to the assembly at its outer marginal portion 82 engaging the chairs, the chairs may be moved outwardly and away from the table to tension the tent-like portion of the cover assembly. Thereafter, an outer portion of the cover is preferably pinched at a location between two laterally adjacent chairs and gently pulled in an out, yard and downward direction, as illustrated in FIG. 6 while moving one of the chairs laterally and toward the other to form a drainage valley between the adjacent chairs extending downwardly from the apex of the tent-like cover.

Figure 7:
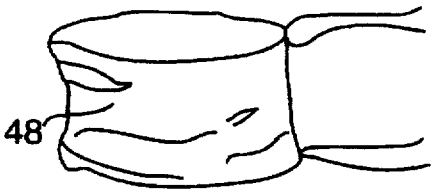
FIG. 7 is a perspective view of a storage pouch for storing the cover.

When the cover 10 is not in use it is preferably stored in situ and for this purpose a container 48 is provided for positioning in generally surrounding relation to an associated portion of the umbrella pole 24 to receive and contain the cover 26 and the strap fastener 44 attached to it, as shown in FIG. 7. The illustrated container 48 comprises a flexible annular pouch preferably made from the same material from which the cover is made. The pouch 48 is positioned on the table 20 in surrounding relation to an associated portion of the umbrella pole 24. The illustrated pouch 48 has upper and lower drawstring closures for dosing the pouch at its upper and lower ends, substantially as shown.

Figure 8:
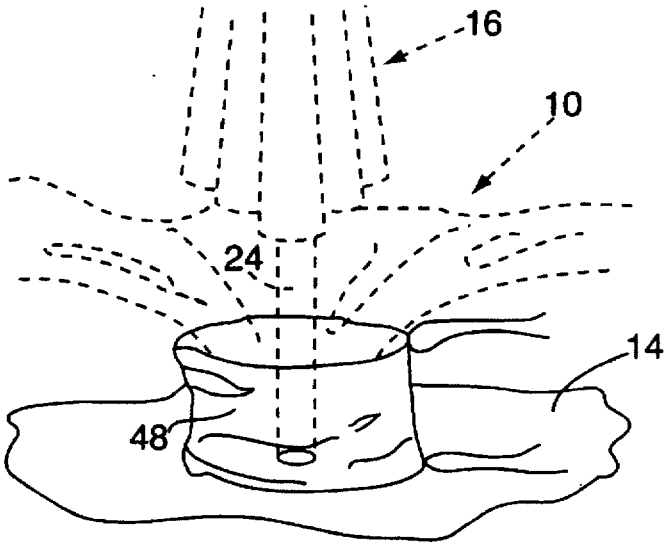
FIG. 8 is a fragmentary perspective view illustrating the step of positioning the cover in the pouch.

The cover is stored in the open pouch by releasing the strap 44 which secures the elevated portion of the cover to the pole and lowering the elevated portion into the pouch after which the outer portions of the cover are gathered inwardly toward the umbrella pole and stuffed into the pouch (FIG. 8). After the cover 26 has been positioned within the pouch the pouch drawstrings are used to close the pouch and secure it in a closed position where it remains on the pole until the next time it is used to cover the table assembly.

Figure 9:
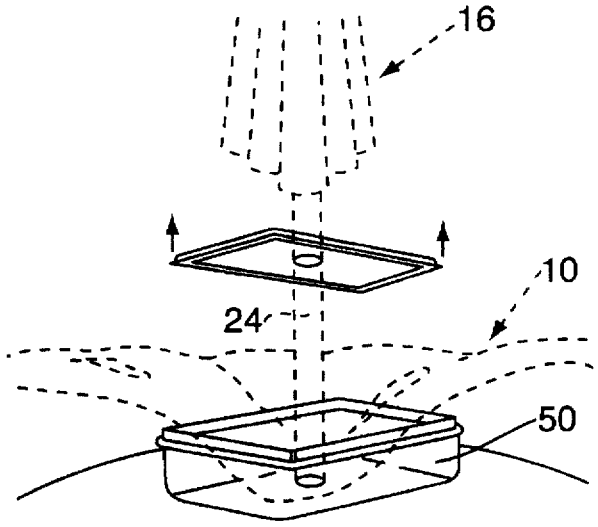
FIG. 9 is a perspective view showing a pouch of another type.

In FIG. 9 there is shown another embodiment of the invention wherein the container for the cover comprises a rigid structure or box 50 having a removable cover. When the cover assembly 26 is in use the container cover remains on the umbrella pole 26 above the elevated portion of the cover, supported by the elevated portion.

In accordance with a further embodiment of the invention a cover assembly is provided for releasable attachment to an object or article of furniture using releasable fasteners which are attached to the article and to the cover at the time the cover is first used to cover the article. The fasteners comprise mating segments or parts, one of which is attached to the article and the other of which is affixed to the cover. When joined together in assembly, the fastener parts releasably secure the cover to the article. Various types of releasable fasteners may be employed in practicing the invention. However, the fastener parts associated with the cover are permanently attached to the cover at the time the cover is put into service.

Figure 10:
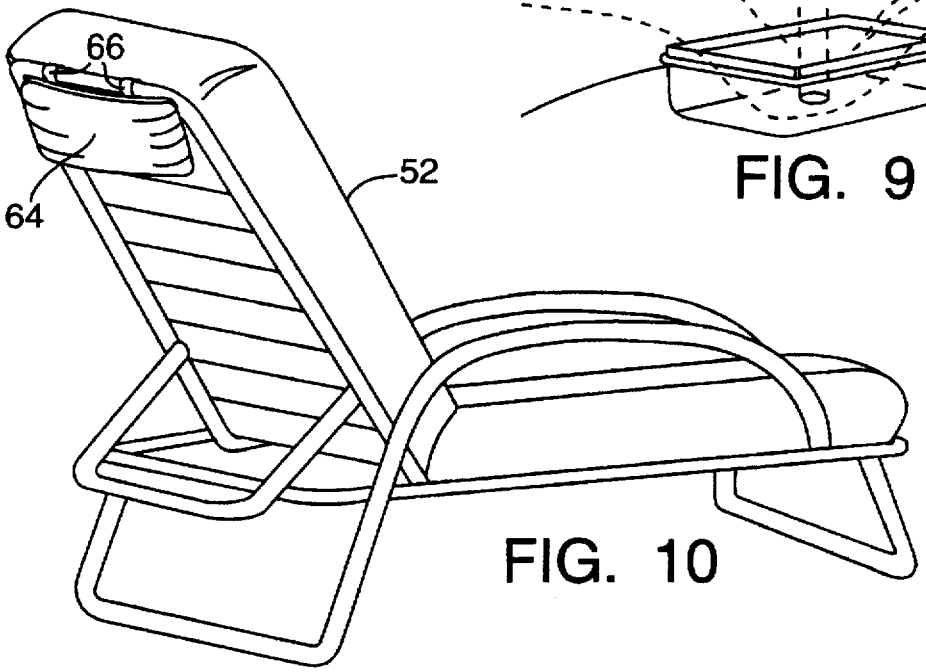
FIG. 10 illustrates a typical chaise lounge chair.

Further referring to the drawings and considering particularly FIGS. 10 and 11 a covering system of the aforedescribed general type is illustrated and described with reference to a chaise lounge 52. The illustrated chaise lounge 52 is of a conventional type and has a elongated couch-like seat and a raised back support at one end of the seat which is substantially higher than the opposite end of the seat. The illustrated cover assembly indicated generally at 54 which includes a cover 55. The cover is formed from a plurality of panels adhesively sewn or otherwise joined together along lines of attachment. The illustrated downwardly open cover has a back panel 56, a front panel 58, a pair of opposing side panels 60, 60 and a top panel 62 which is inclined downwardly from the upper end of the back panel to the upper end of the front panel, substantially as shown. The cover assembly is preferably stored in situ and for this reason the assembly includes a storage container or pouch 64 which is preferably formed from the same material used in making the cover. A flexible strap 66 is attached to the inner surface of the pouch to extend from the pouch and has a patch of pressure sensitive adhesive at its free end covered by release material, for a purpose hereinafter explained. The pouch is preferably attached to a cross-member at the rear of the chaise using straps sewn or otherwise affixed to the pouch and which comprise hermaphroditic separable hook and loop fasteners, so that each strap may be looped about a cross-member and attached to itself.

Figure 11:
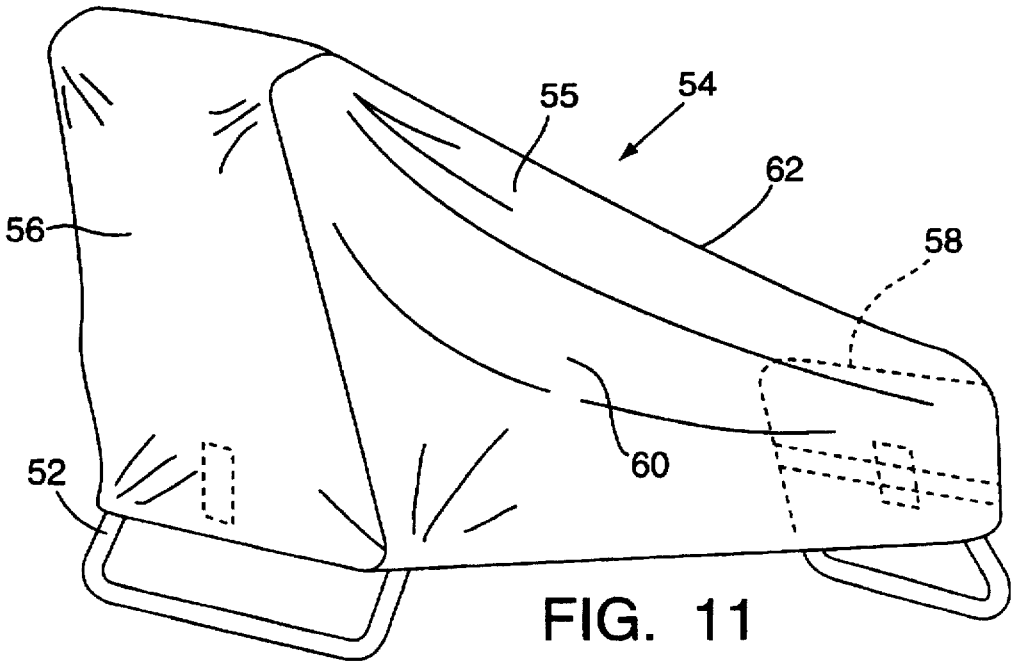
FIG. 11 shows the chair of FIG. 16 in covered position.
Figure 12:
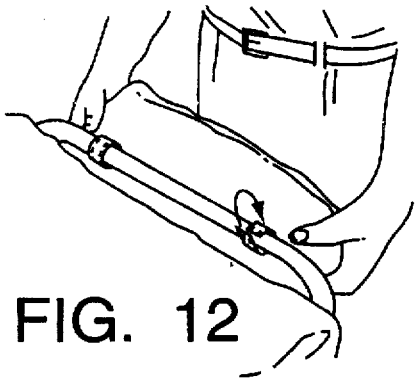
FIG. 12 illustrates the step of attaching a storage pouch to a chaise lounge.

After the pouch 64 has been attached to the chaise 52 the cover is positioned on the chaise, substantially as shown in FIG. 11 and adjusted so that no part of the cover touches the floor or ground surface upon which the chaise is supported.

Figure 13:
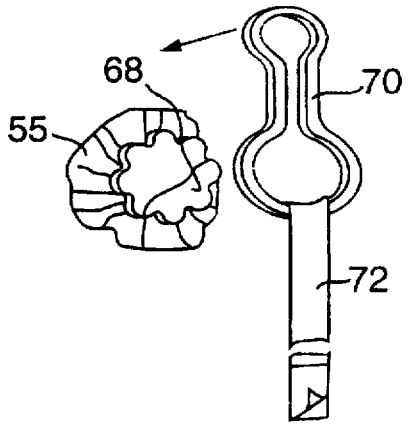
FIG. 13 is an exploded fragmentary perspective view of a garter-type fastener.
Figure 14:
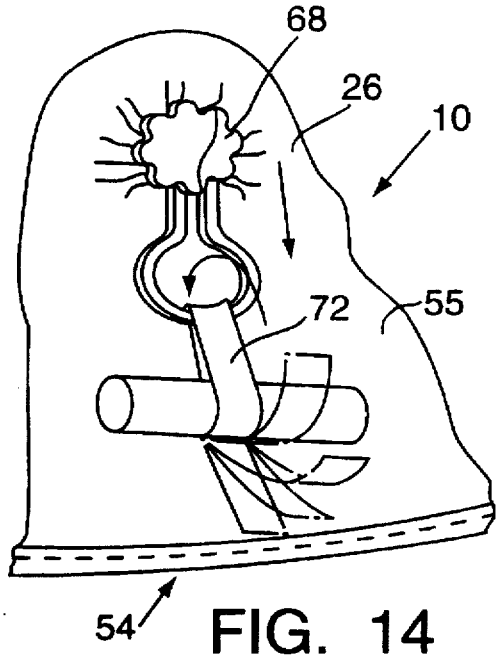
FIG. 14 is a fragmentary perspective view of the garter fastener of FIG. 13 showing the fastener attached to the cover and secured to a cross-member.
Figure 16:
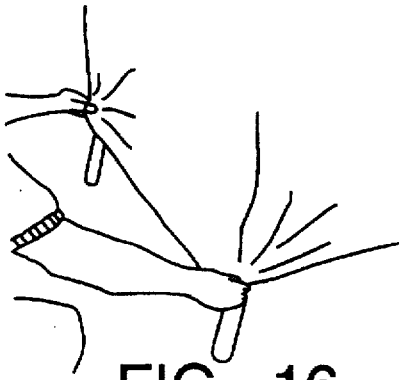
FIG. 16 illustrates the step of locating the position for applying tension to the back panel of a furniture cover.
Figure 17:
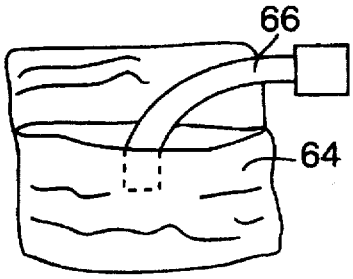
FIG. 17 illustrates the storage container and flexible strap attachable to a chaise as in FIG. 10.

After the cover has been properly positioned on the chaise lounge the locations of the fasteners which secure the cover to the lounge chair are determined. Various types of separable fasteners may be used for this purpose. However, garter-type fasteners and flexible hermaphroditic strap fasteners employed in combination are presently preferred for this purpose. A typical fastener assembly of this type is shown in FIGS. 13 and 14 and includes a button 68, a holder or retaining ring 70 which snaps over the button and an hermaphroditic releasable retaining strap 72 which is secured to the retaining ring 70, substantially as shown. The strap carries both hook and loop fasteners and may be attached to itself in a manner well known in the art.

Typically, a fastener is attached to the cover by pushing a button 68 inwardly from the outer side of the cover 55 and snapping a holder 70 over the cover material and the button 68 at the inner side of the cover.

The first fastener is preferably located at the rear of the chaise on the rear panel and above a cross-member located near the lower part of the chaise. A fastener button is attached to the rear panel at a position centrally of and above the selected cross-member. The garter fastener is secured to the cover a sufficient distance above the cross-member t6 allow for tightening of the releasable strap fastener associated with it. The button location should be determined while pulling downwardly on the rear panel 58 to maintain the panel in tension. After the rear garter fastener has been attached to the rear panel a strap fastener 72 is looped around the holder and around the cross-member, drawn up tight to apply tension to the back panel, and secured to itself. When this operation has been completed there should be tension in the back panel of the cover.

While the back panel is attached to an associated cross-member at the rear of the chaise the aforesaid fastener attaching operation is repeated to secure a garter type fastener at a central location to the front panel for releasable attachment to a cross-member at the front of the chaise. When affixing the cover to the front of the chaise it is necessary that the cover be taunt with no sag in the top panel. This tension keeps water from puddling on the top surface. When properly tensioned there will be a Vee formed in the covering material and extending from the upper corners of the top panel to the center of the junction between the front panel and the top panel.

Figure 15:
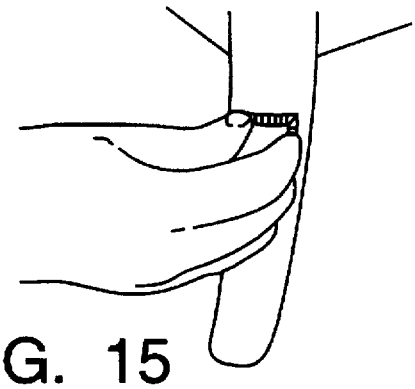
FIG. 15 illustrates the step of securing another type of fastener to a chair leg.

When the article of furniture to be covered does not have exposed cross-members to which retaining straps may be readily secured an alternate attaching arrangement must be employed. In this instance the releasable fastener may comprise a flexible strap or loop fastener and having a patch of pressure sensitive adhesive covered by release material at one of its ends. A mating hook fastener which also carries a patch of pressure sensitive adhesive covered by a release material is releasably connected to the other end of the strap by hook and loop engagement. The latter fastener element is provided for attachment to a suitable surface on the article to be covered, such as the leg of a chair, as shown in FIG. 15.

The method for attaching the cover is generally as aforedescribed wherein the cover is first arranged in covering relation to the article and thereafter suitable locations at the rear of the article are selected and patches of fastening material adhered to the article at these locations. The free ends of the straps which are connected to the article are thereafter attached to the inner surface of the cover back panel while the back panel is maintained in tension. The procedure is repeated at the front end of the article to releasably connect the cover to the article with the top panel of the cover in tension.

If a storage container pouch is to be provided for storing the cover in situ, an appropriate arrangement must be made to secure the container or pouch to the article of furniture. After the cover has been secured to the article of furniture the location of the flexible strap 66 relative to the cover is determined. The furniture cover is then removed and the strap 66 is attached to the cover at the determined location. However, when the pouch is secured, the furniture cover is attached to the pouch by a flexible strap connected to the pouch in the manner generally aforedescribed. This arrangement enables the cover to be packed or folded into the pouch in a proper position of orientation relative to the article so that when the cover is removed from the pouch it will be properly oriented for immediate positioning on the article.

I claim:

1. A method for covering at least one article of furniture comprising the steps of positioning a cover on the article of furniture, locating the position of releasable fasteners for securing the cover on the article while the cover is on the article, removing the cover from the article, attaching the releasable fasteners to the cover, repositioning the cover on the article, and securing the cover to the article using the releasable fasteners.

* * * * *